United States Patent [19]

Schall

[11] 4,349,065

[45] Sep. 14, 1982

[54] MOLD PRODUCING GLOBE-SHAPED BELLS WITH SINGLE-PIECE SHELLS

[76] Inventor: William R. Schall, Star Rte., Box 137, Apollo, Pa. 15618

[21] Appl. No.: 187,395

[22] Filed: Sep. 15, 1980

[51] Int. Cl.[3] ..... B22C 9/10; B22C 9/22

[52] U.S. Cl. ..... 164/368; 164/365; 164/366; 164/369

[58] Field of Search ..... 164/365–368, 164/369, 9–11, 132, 131, 137

[56] References Cited

U.S. PATENT DOCUMENTS

| | | | |
|---|---|---|---|
| 390,907 | 10/1888 | Sage | 164/9 |
| 1,170,180 | 2/1916 | O'Dowd | 164/9 |
| 1,474,729 | 11/1923 | Ogden | 164/9 |
| 1,913,107 | 6/1933 | DeBruyne | 164/11 |
| 3,254,849 | 6/1966 | Clements | 164/367 X |

*Primary Examiner*—R. L. Spruill
*Assistant Examiner*—J. Reed Batten, Jr.
*Attorney, Agent, or Firm*—James C. Wray

[57] ABSTRACT

A mold producing one or more globe-shaped bells, each of which is cast as a one-piece shell enclosing a tumbling ball-bearing or jinglet. Production of the one-piece shell is made possible by pouring molten metal over a spherical core, supported by small "feet" inside the globe-like cavity of the mold. When the shell is removed from the mold, the core, in which the ball-bearing or jinglet is embedded, can easily be broken down into particles which fall out holes in the shell's surface.

6 Claims, 3 Drawing Figures

MOLD PRODUCING GLOBE-SHAPED BELLS WITH SINGLE-PIECE SHELLS

BACKGROUND OF THE INVENTION

The present invention relates to a mold producing one or more globe-shaped bells, each of which is cast as a one-piece shell enclosing a ball-bearing or jinglet which will tumble freely within it.

The shell of conventional globe-shaped bells, which can serve as ornaments, rhythm instruments, warning devices or means of identifying animals or moving objects by sound, is cast in two separate pieces. The upper piece or hemisphere of such a bell is then fused to the lower piece or hemisphere, into which a ball-bearing or jinglet has been placed.

BRIEF DESCRIPTION OF THE INVENTION

It is an object of the invention to provide a mold producing one or more globe-shaped bells, each of which consists of a ball-bearing or jinglet enclosed in a shell which is cast in one piece in order to reduce the time and cost of production.

It is another object of the invention to provide a globe-shaped bell whose shell is cast in one piece and is, therefore, inherently stronger than a conventional globe-shaped bell whose shell is cast of two pieces which are fused together.

DETAILED DESCRIPTION OF THE INVENTION

Figure 1:
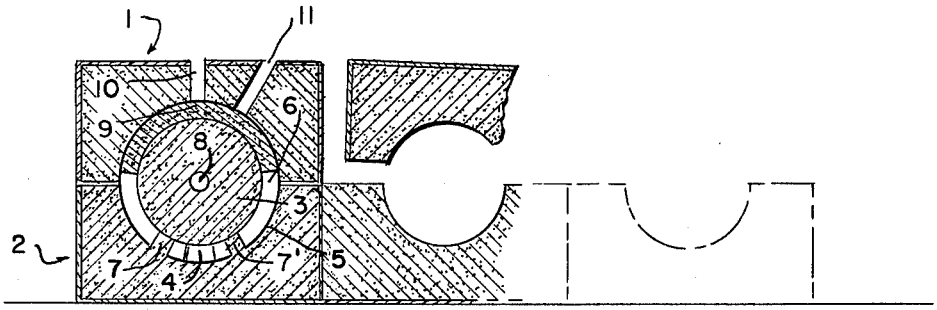
FIG. 1 shows a cross-section of a portion of a mold producing two or more bells simultaneously.

In FIG. 1, upper block 1, which, during the casting process, fits flush on lower block 2, is filled with a sand-based or other commercial molding composition. Lower block 2 is filled with the same composition.

Inner core 3, which is formed of the same sand-based or other commercial molding composition, is supported by two or more "feet" 4 which extend from lower block 2's dome-like depression 5, through cavity 6 to the lower surface of inner core 3.

Also extending from lower block 2's dome-like depression 5 through cavity 6 to inner core 3 are two or more round or nearly round protrusions of molding composition, 7 and 7', which will form holes in the surface of the shell, which will be formed in cavity 6 during the casting process.

A ball-bearing of jinglet 8 rests securely in the molding composition of inner core 3.

Above inner core 3, extending from upper block 1, is a protrusion in the form of a slit or throat 9. Protrusion 9 will form a slit or throat-shaped hole in the surface of the shell, which will be formed in the cavity during the casting process. Two slit or throat-shaped protrusions which intersect at a 90° angle and cut each other into halves may extend from the upper block 1 to the surface of the inner core 3.

Extending from the top, outer surface of upper block 1 to cavity 6 are fill tunnel 10, through which molten metal is poured during the casting process; and air tunnel 11, through which air can escape during the casting process.

Figure 2:
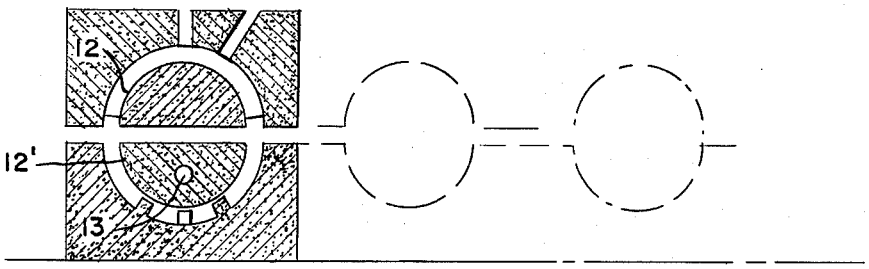
FIG. 2 shows a similar portion of a mold producing two or more bells simultaneously.

FIG. 2 shows a portion of a mold similar to the mold of FIG. 1 for producing two or more bells simultaneously. However, in FIG. 2, the inner core is composed of two separate pieces or hemispheres, 12 and 12'. Ball-bearing of jinglet 13 is embedded in core piece 12'.

Figure 3:
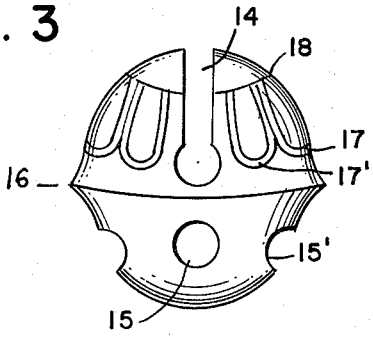
FIG. 3 shows a side view of a bell produced from a mold, as shown in FIGS. 1 and 2.

FIG. 3 shows a side view of a bell produced from a mold, as shown in FIGS. 1 and 2. It is distinguished by a slit or throat-shaped hole 14 extending across the top of the bell's upper hemisphere.

A bell produced from a mold, as shown in FIG. 1 and 2, is further distinguished by two or more round or nearly round holes, 15 and 15', which perforate its lower hemisphere. In addition, such a bell may or may not be distinguished by a bulging ring 16 at the point where upper block 1 and lower block 2 of FIG. 1 are joined. Two or more score parabolas, 17 and 17', extend from a scored circle 18 on the bell's upper hemisphere.

The invention is particularly concerned with the production of globe-shaped bells cast as one-piece shells which enclose a tumbling ball-bearing or jinglet.

In order to form such bells in a one-step casting process, molten metal is poured through fill tunnel 10 in FIG. 1. The molten metal then flows through cavity 6, around protrusions 9, 7 and 7' and feet 4 to form a shell around the inner core 3 of sand-based or other commercial molding composition.

When the shell is cooled and removed from the blocks within which it was formed, the shell is agitated in order to break up the particles which formed the inner core of the mold. Those particles are then shaken out of the holes formed by protrusions 9, 7 and 7'. When all of the particles are shaken out, there will remain a ball-bearing or jinglet 8, as shown in FIG. 1, which will tumble freely within the shell.

Bells formed by the process described above range in size from 0.050–3 inches in diameter, although 0.065–1.8 inches in diameter is a preferable size range: are cast from bronze or any other suitable metal; and contain a ball-bearing or any other suitable jinglet.

Each such bell may be distinguished by two or more holes in its lower surface, although 2–4 is a preferable number; may be distinguished by one slit or throat-shaped hole or two intersecting slit or throat-shaped holes on its upper surface; may be distinguished by a decorative, scored circle on its upper surface; may be distinguished by two or more parabolas extending from such a circle on its upper surface, although 6–8 is a preferable number; may be distinguished by a bulging ring 16, as shown in FIG. 3; or may be distinguished by no such ring or scored marking of any kind.

Because a mold section, as shown in FIGS. 1 and 2, can be easily attached to one or more identical mold sections to speed the casting process when more than one bell is desired, a multiple casting mold can be produced which can accommodate about 2–200 bells, although about 8–48 is a preferable number.

What is claimed is:

1. A bell mold comprising an upper block filled with a sand-based commercial molding composition, into which a dome-like depression has been made; a lower block filled with a sand-based commercial molding composition, into which a dome-like depression has been made; an inner core; formed of a sand-based molding composition, which is smaller than the globe-like cavity formed when the upper and lower blocks are joined; at least two feet extending from the surface of the dome-like depression in the lower block to the inner core which they lift and hold in place; a tunnel, extending from the outer surface of the upper block to the inner surface of its dome-like depression, through which molten metal can be poured; at least one tunnel extending from the upper block's outer surface to the inner surface of its dome-like depression through which air can escape during a casting process; and a jinglet, embedded in the inner core.

2. The mold of claim 1, whose upper block's dome-like depression is distinguished by a slit-shaped; protrusion extending to the surface of the inner core.

3. The mold of claim 1, whose upper block's dome-like depression is distinguished by two slit-shaped protrusions extending to the surface of the inner core, which intersect at a 90° angle and cut each other into halves.

4. The mold of claim 1, whose lower block's dome-like depression is distinguished by at least two protrusions extending to the surface of the inner core.

5. The mold of claim 1 whose inner core is composed of a solid, spherical mound of sand-based molding composition.

6. The mold of claim 1 whose inner core is composed of two semi-spherical molds of sand-based molding composition.

* * * * *